US005627552A

United States Patent [19]

Farrar et al.

[11] Patent Number: 5,627,552

[45] Date of Patent: May 6, 1997

[54] ANTENNA STRUCTURE FOR USE IN A TIMEPIECE

[75] Inventors: Penny Farrar; Bjorn Kjelsberg, both of Bienne, Switzerland

[73] Assignee: ETA SA Fabriques d'Ebauches, Grenchen, Switzerland

[21] Appl. No.: 451,539

[22] Filed: May 26, 1995

[30] Foreign Application Priority Data

May 5, 1995 [EP] European Pat. Off. ..... 95106835

[51] Int. Cl.[6] ..... H01Q 1/12

[52] U.S. Cl. ..... 343/718; 343/741; 343/866

[58] Field of Search ..... 343/702, 718, 343/741, 742, 866, 867; 455/344, 351; H01Q 1/12, 7/00

[56] References Cited

U.S. PATENT DOCUMENTS

| | | | |
|---|---|---|---|
| 4,769,655 | 9/1988 | Dickey | 343/718 |
| 4,884,252 | 11/1989 | Teodoritis et al. | 343/718 |
| 5,134,724 | 7/1992 | Gehring et al. | 343/718 |
| 5,144,325 | 9/1992 | Kurcbart | 343/718 |
| 5,168,281 | 12/1992 | Tokunaga | 343/718 |
| 5,172,348 | 12/1992 | Paratte | 368/47 |

FOREIGN PATENT DOCUMENTS

| | | | |
|---|---|---|---|
| 0169401 | 12/1981 | Japan | 343/718 |
| 0425205 | 1/1992 | Japan | 343/718 |
| 6006124 | 7/1994 | Japan | H01Q 7/00 |
| 2242399 | 10/1991 | United Kingdom | 343/718 |

OTHER PUBLICATIONS

"Swatch Pager", Meister et al., *Jahrbuch der Deutschen Gesellschaft Fur Chronometrie*, vol. 43 (1992) pp. 157–158 Oct., 1992.

*Primary Examiner*—Donald T. Hajec
*Assistant Examiner*—Tan Ho

[57] ABSTRACT

Antenna structure for use with a timepiece (100) adapted to be worn on the wrist and including a microreceiver (117, 118), said antenna structure comprising an antenna (81) comprising at least one coil (85,86,87) and being capable of capturing an electromagnetic field bearing radio diffused messages for receipt and transformation by said microreceiver (117,118) into data perceptible to a user of said timepiece, conductive leads (82,83) for connecting said antenna (81) to said microreceiver (117,118), and a non-conductive support structure (84) comprising a first portion (90) onto which antenna (81) is mounted. The support structure (84) further comprises a second portion unitary (91) with and projecting from said first portion (90) and onto which said conductive leads (82,83) are mounted.

16 Claims, 14 Drawing Sheets

ANTENNA STRUCTURE FOR USE IN A TIMEPIECE

BACKGROUND OF THE INVENTION

The present invention relates generally to antennas, their manufacture and their mounting in timepieces. In particular, the invention relates to antennas capable of capturing an electromagnetic field bearing radio diffused messages and to timepieces including such antennas and a microreceiver for receiving messages captured by the antenna in order to transform such messages into data perceptible to the timepiece wearer.

Many timepieces exist which are equipped with an antenna and a microreceiver in order to capture radio diffused signals. If such a timepiece is in the form of a wristwatch, the antenna is generally located within the bracelet. However, locating the antenna in the bracelet of a watch gives rise to problems of providing connections between the microreceiver and the antenna which forms part of the bracelet, this latter being a movable element and generally hinged to the case by means of pins or lugs. The leadthrough of the antenna conductor gives rise to constructional problems with complicated means for connecting these two elements. At the leadthrough, for instance, the conductors are mechanically stressed and they are prone to break if means are not provided to avoid such breakage. These means are difficult to manufacture and complicate not only the assembly of the timepiece but also the changing of the bracelet, a bracelet moreover which must be specially built since it bears an antenna and which may not always be exchanged with a bracelet readily found on the market.

Attempts have been made to simplify the construction of such timepieces by housing both the antenna and the microreceiver within the case itself, thereby avoiding the mechanical stressing of the conductors which connect the antenna to the microreceiver. Swiss Patent No. 672 870, by the present applicant, describes in one embodiment a timepiece including an inductive antenna and a microreceiver entirely confined within the space bounded by the case. The longitudinal axis of the coil windings forming the antenna is arranged parallel to the longitudinal direction of the bracelet. In this embodiment, the windings each comprise two interconnected sections, one of which is formed by a metallisation layer deposited under the glass and the other of which is formed by a metallic wire sunk into the back cover of the case.

Swiss Patent No. 679 356, also by the present applicant, describes an alternative construction of this timepiece, in which the coil windings are wound around a second glass and an internal casing provided in the case. Grooves are provided in the second glass and in the internal casing to facilitate the placement of the windings. The connection between the RF module of the microreceiver and the antenna is effected by bringing the coil windings directly into contact the RF module and thereafter soldering them in place.

OBJECTS AND SUMMARY OF INVENTION

Swiss Patent No. 672 870 additionally shows in a further embodiment a timepiece including a capacitive antenna and a microreceiver which are also entirely confined within the space bounded by the case. In this embodiment, the antenna is arranged with a sensitive axis perpendicular to the longitudinal direction of the bracelet. The antenna comprises two plates, one of which is formed by a metallisation layer deposited under the glass and the other of which is formed by a metallic back cover. The connections between the plates of the antenna and the inputs of the microreceiver are by spring loaded leaf-springs.

Whilst the above described arrangements have enabled a simplification of such timepieces, there nevertheless remains a need to further improve their assembly and general construction. In particular, there exists a need to simplify and improve the structure of the antenna, its connection to the microreceiver and its assembly in the timepiece.

In the above described arrangements, the placement of the antenna in the timepiece requires either the inclusion of several additional members for the mounting of the antenna, or the fixing of the antenna components in or onto the various elements of the timepiece prior to assembly. Such arrangements clearly complicate the manufacture of such timepieces and require the precise and careful handling of the timepiece during assembly, and thus unnecessarily add to the cost of the assembled timepiece.

Furthermore, the connection of the antenna to the microreceiver in existing timepieces is complicated by the need either to bring the antenna itself directly into contact with the microreceiver, to connect separate leads between the antenna and the microreceiver once the timepiece has been assembled or to provide delicate connection devices.

An object of the present invention is therefore to provide an antenna structure for use with a timepiece of the type defined above which ameliorates or overcomes the disadvantages of known antenna structures.

Another object of the invention is to provide an antenna structure which can be easily mounted in such a timepiece.

A further object of the invention is to provide an antenna structure for use with a timepiece of the type defined above which facilitates the connection of the antenna to the microreceiver.

An additional object of the invention is to provide an antenna structure which facilitates the assembly and general construction of the timepiece in which it is mounted.

In accordance with the invention, these objects are achieved in a antenna structure for mounting inside the case of a wrist watch and including a microreceiver. The antenna structure comprises at least one coil and is capable of capturing an electromagnetic field bearing radio diffused messages for receipt and transformation by the microreceiver into data perceptible to a user of the timepiece. In addition to conductive leads for connecting the antenna to the microreceiver, the antenna structure also includes a non-conductive support structure comprising a first portion onto which the antenna is mounted and a second portion unitary with and projecting from the first portion and onto which the conductive leads are mounted.

An antenna structure having these characteristics has the advantages of being simple and inexpensive to manufacture and of being able to be placed in the timepiece during the assembly of this latter in a convenient manner. A simple connection can then be made to the microreceiver in order to ensure the operation of the antenna. Accordingly, the complexity of the assembly process and the overall construction of the timepiece, as well as the associated cost of manufacture, is significantly reduced.

preferably, the support structure is formed completely separately from the other elements of the timepiece. The antenna structure can thus manufactured independently of these other timepiece elements, such as the dial and the glass, and incorporated in the timepiece during final assembly. The manufacture of the timepiece is then simplified as considerations associated with the finish or other aesthetic properties of the timepiece may be ignored during the construction of the antenna structure.

The following description refers in more detail to the various features of the present invention. In order to facilitate the understanding of the invention, reference is made in the description to the accompanying drawings where the antenna structure and timepiece including the antenna structure are illustrated in several embodiments. It is to be understood, however, that the invention is not limited to the embodiments as illustrated in the drawings.

DETAILED DESCRIPTION

Figure 1:
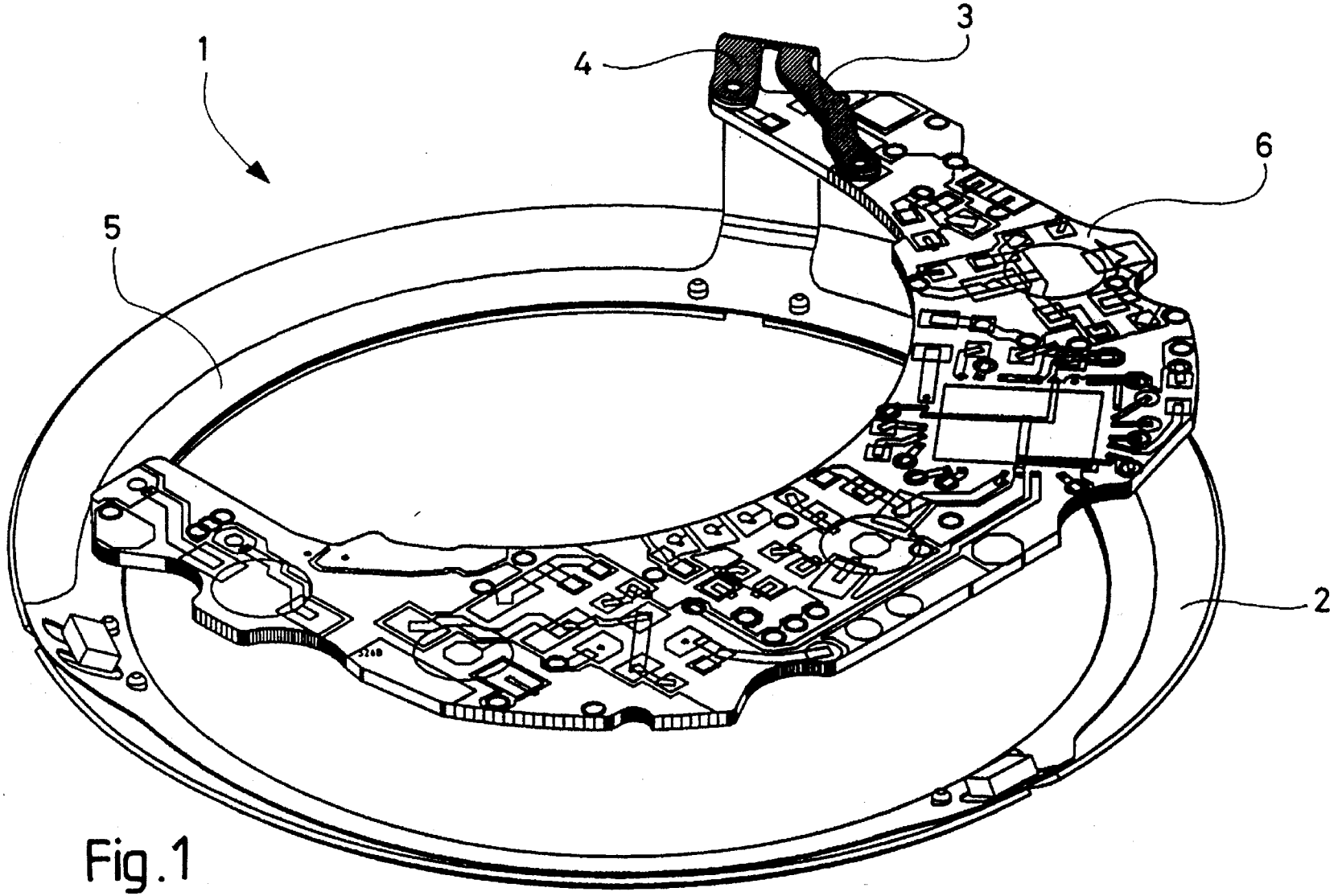
FIG. 1 is a perspective view of a first embodiment of the antenna structure according to the present invention.
Figure 2:
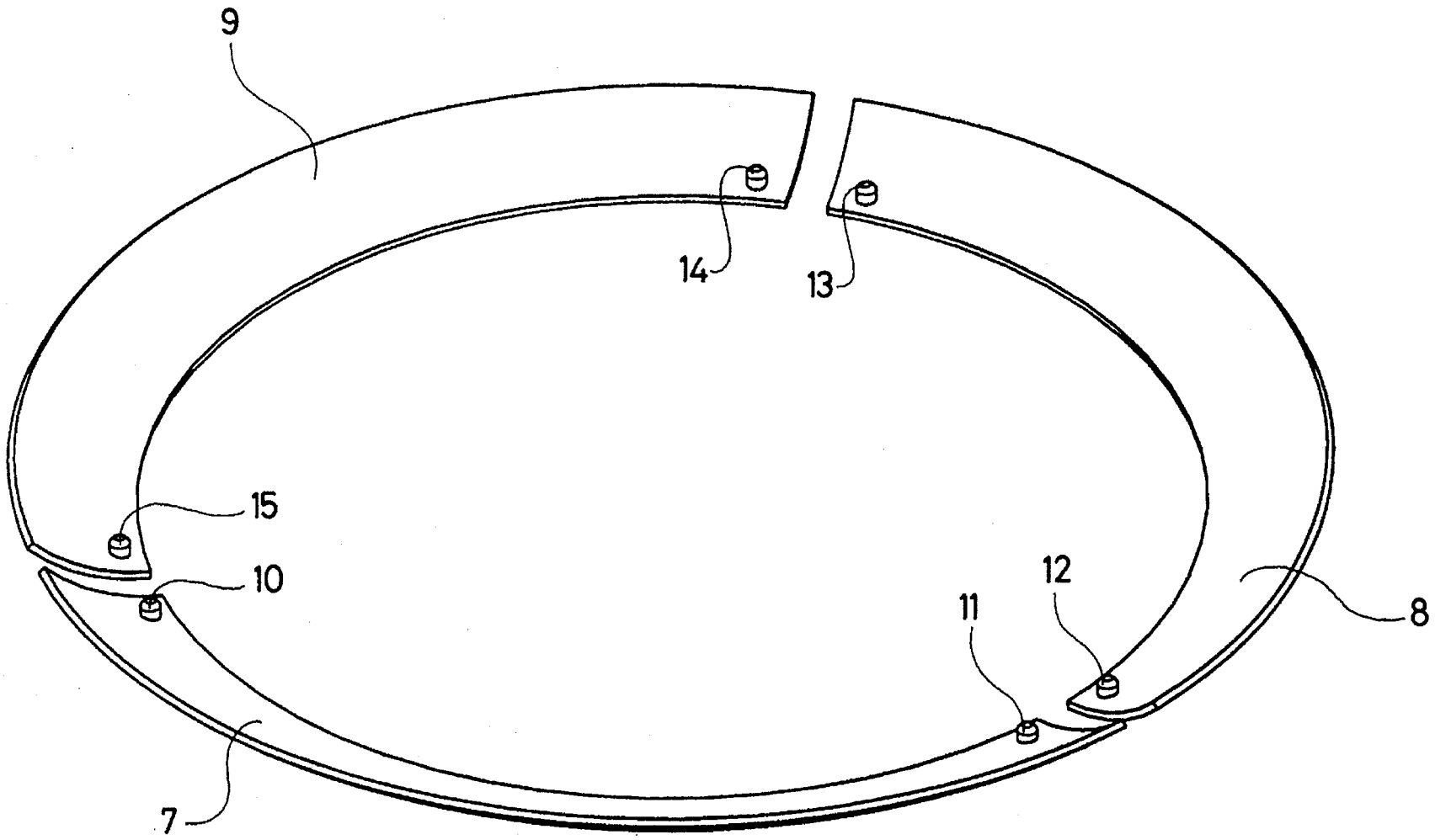
FIG. 2 is a perspective view of the segments forming the coil winding of the antenna structure of FIG. 1.

Referring now to FIG. 1 of the drawings, there is shown an antenna structure 1 according to the present invention comprising an antenna 2 and conductive leads 3 and 4 mounted to a support structure 5. The conductive leads 3 and 4 connect the antenna 2 to a radio-frequency (RF) module 6 of a microreceiver incorporated in a timepiece, as will be explained below. The antenna 2 is an inductive antenna which, as best shown in FIG. 2, comprises one coil winding divided into three segments 7, 8 and 9. In this embodiment, the three segments 7, 8 and 9 are of equivalent lengths, but in other embodiments a different number of segments may be used. Furthermore, the antenna segments need not necessarily be equal in length. The three segments 7, 8 and 9 are preferably made partially or completely from copper. Nevertheless, the skilled person will appreciate that other materials, such as silver, gold or like-conductors having appropriate electromagnetic properties, may be used in the construction of the antenna. The segments 7, 8 and 9 are each provided with two positioning pins respectively 10 and 11, 12 and 13 and 14 and 15 to assist in the positioning of the antenna with respect to the support structure during assembly of the antenna structure 1. It to be understood that various other means known to the skilled worker may also be used to fix the antenna to the support structure.

Figure 3:
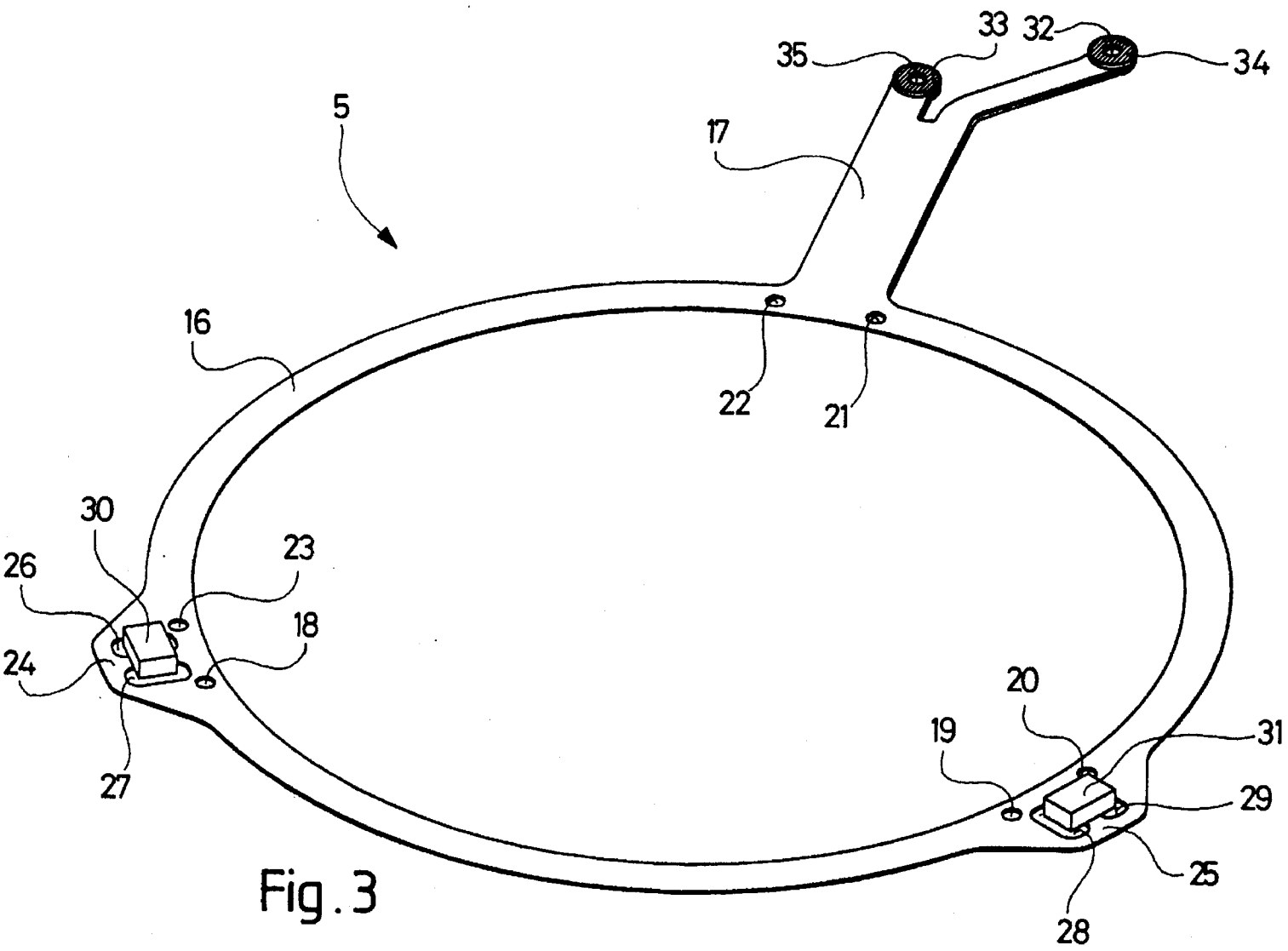
FIG. 3 is a perspective view of the support structure and capacitive elements of the antenna structure of FIG. 1.

FIG. 3 shows the support structure 5 comprising a first portion 16 onto which the antenna 2 is mounted and a second portion 17 unitary with and projecting from the first portion 16 and onto which the conductive leads 3 and 4 are mounted. The support structure 5 is preferably made from a non-conductive dielectric material. In order to facilitate the assembly of the antenna structure in a timepiece, the support structure is also preferably flexible. Examples of materials which have been found suitable in this regard are Kapton® and Espanex®.

positioning holes 18, 19, 20, 21, 22 and 23 are provided in the support structure 2 for co-operation respectively with positioning pins 10, 11, 12, 13, 14 and 15 of the antenna coil segments 7, 8 and 9. The support structure 5 further comprises laterally projecting tabs 24 and 25 through which are provided openings 26, 27, 28 and 29. Capacitive elements 30 and 31 are mounted on the tabs 24 and 25 such that, when the antenna 2 is mounted to the support structure 5, the capacitive elements 30 and 31 respectively connect the coil segments 7 and 9 and the coil segments 11 and 12 through the openings 26, 27, 28 and 29. A further capacitive element (not shown) is provided on the RF module 6 and connects the coil segments 8 and 9.

Figure 5:
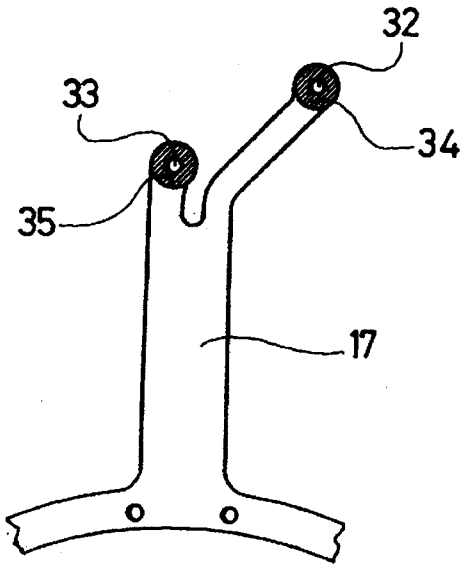
FIG. 5 is a plan view from above of second portion of the support structure of FIG. 3, as seen from FIG. 2.
Figure 4:
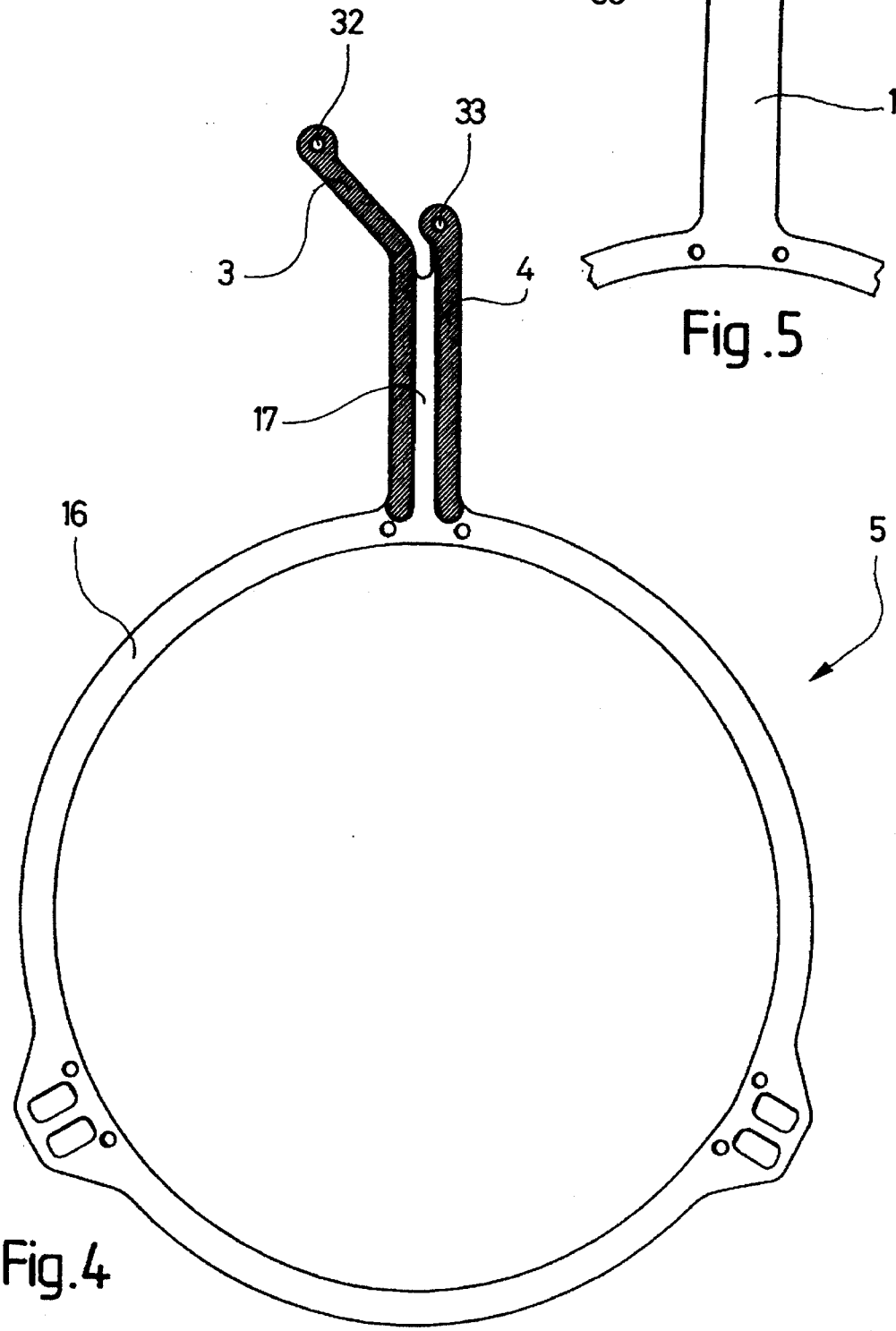
FIG. 4 is a plan view from below of the support structure of FIG. 3, as seen from FIG. 2.

FIG. 4 shows a plan view of the underside of the support structure 5 as shown in FIG. 3. The conductive leads 3 and 4 are constituted by a metallisation layer formed on the second portion 17 of the support structure 5. The placement of the conductive leads 3 and 4 on the support structure 5 is chosen so that they provide an electrical connection between the antenna 2, when mounted to the support structure 5, and the RF module 6. In that regard, two holes 32 and 33 are formed in the end of the second portion 17. Discs 34 and 35 (FIG. 5) of conductive material, such as copper, are soldered to the opposing surface of the second portion 17 of the support structure, the solder flowing through the holes 32 and 33 so as to connect the discs 34 and 35 to the metallisation layer and thereby facilitate electrical connection of the conductive leads 3 and 4 to the RF module 6.

Figure 6:
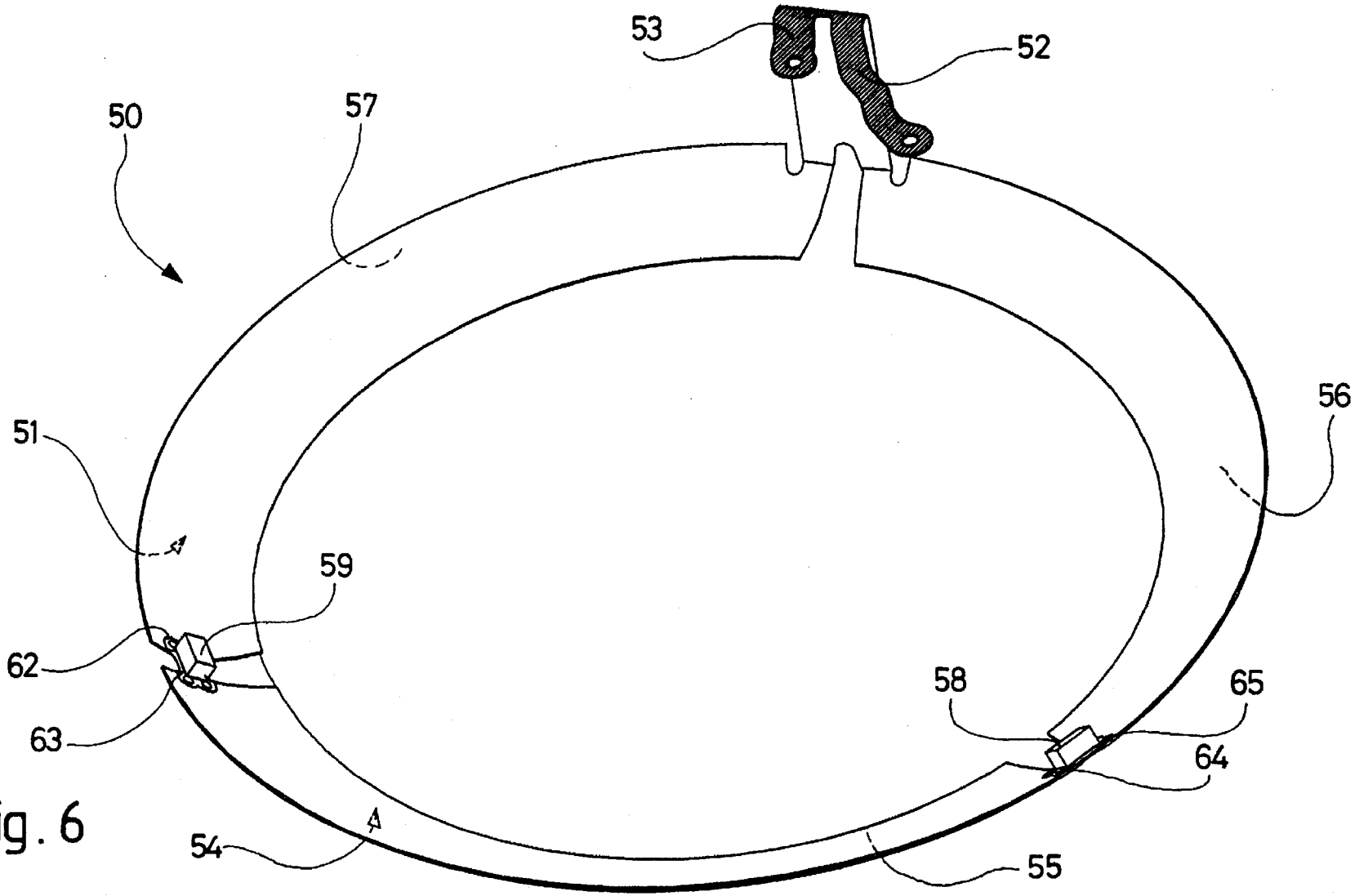
FIG. 6 is a perspective view of a second embodiment of the antenna structure according to the present invention.

Referring now to FIG. 6, there is shown another antenna structure 50 according to the present invention comprising an antenna 51 and conductive leads 52 and 53 mounted to a support structure 54. The antenna 51 and the conductive leads 52 and 53 are constituted by a metallisation layer deposited onto the surface of the support structure 54. The conductive leads 52 and 53 are adapted to connect the antenna 51 to a radio-frequency (RF) module 6 of a microreceiver shown in FIG. 1. Similarly to the antenna 2, the antenna 51 is an inductive antenna which comprises one coil divided into three segments 55, 56 and 57 of equivalent lengths. Capacitive elements 58 and 59 respectively interconnect the antenna coil segments 55 to 56 and 55 to 57. A further capacitive element (not shown) is provided on the RF module 6 of FIG. 1 and interconnects the coil segments 56 to 57.

Figure 7:
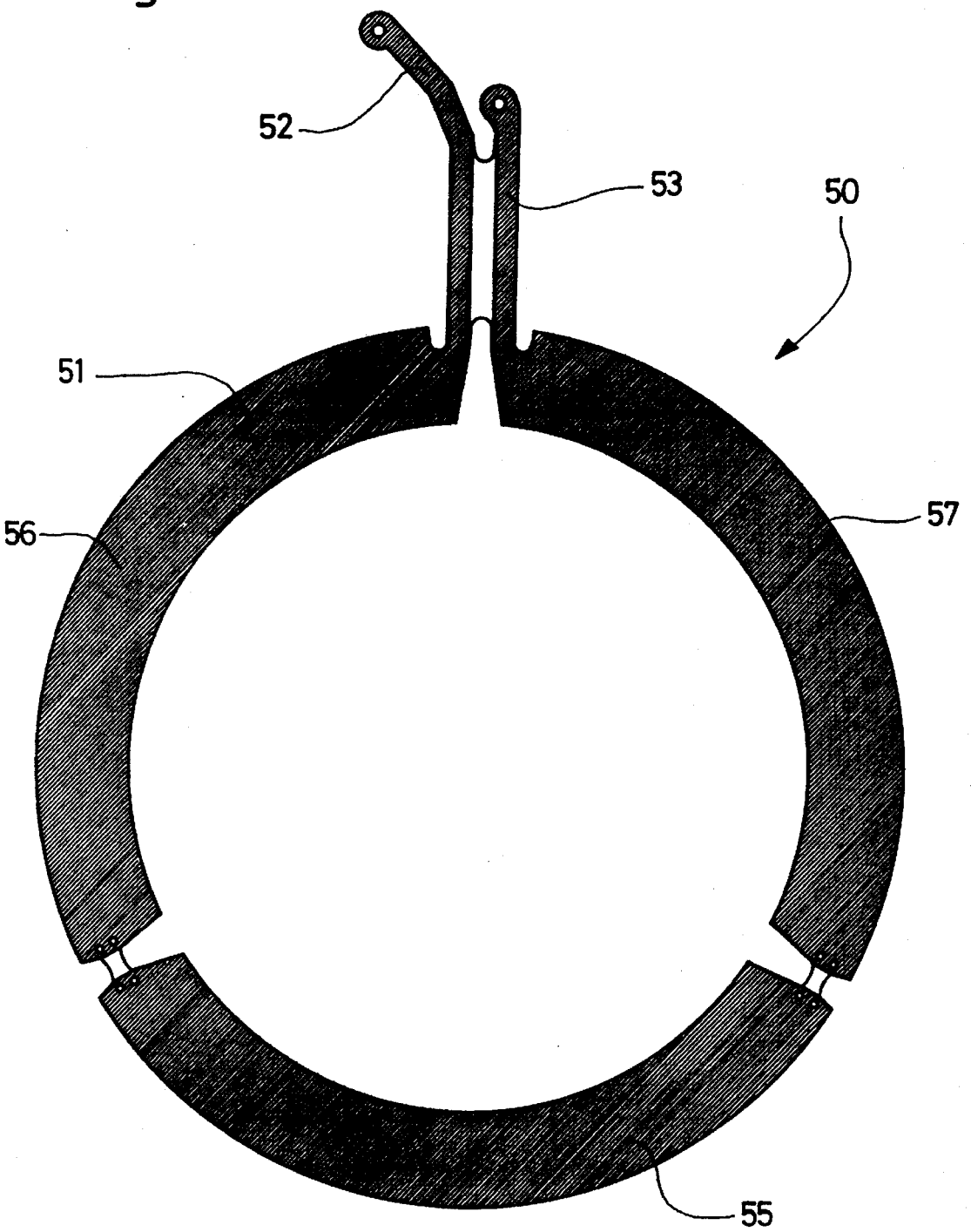
FIG. 7 is a plan view from below of the support structure of the antenna structure of FIG. 6, as seen from FIG. 6.
Figure 8:
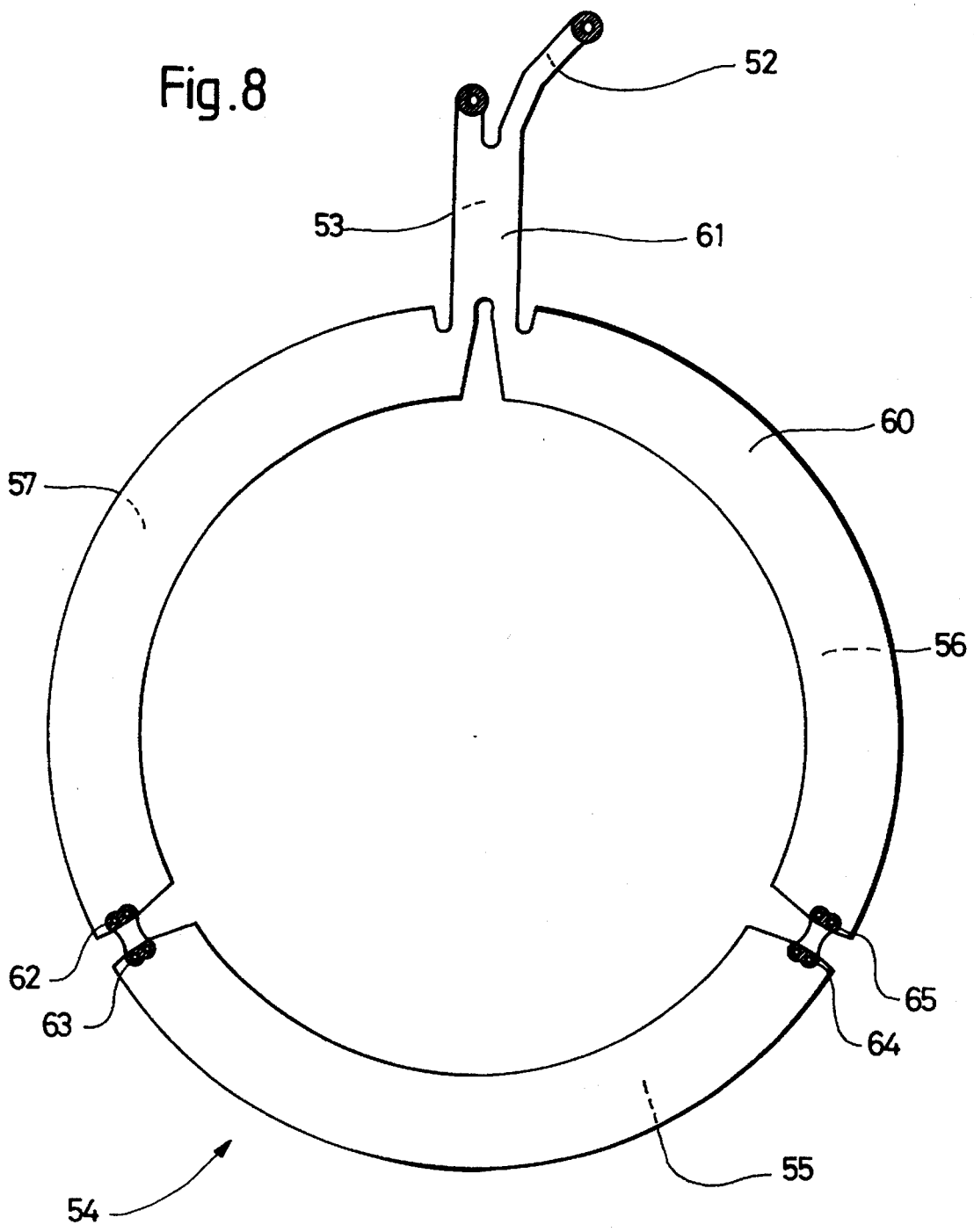
FIG. 8 is a plan view from above of the support structure of the antenna structure of FIG. 6, as seen from FIG. 6.

FIG. 7 shows a plan view of the underside, as seen from FIG. 6, of the antenna structure 50 whilst FIG. 8 shows a plan view of the opposing face of the same antenna structure 50. For the sake of clarity, the capacitive elements 58 and 59 have been omitted from these views. The support structure 54 comprises a first portion 60 onto which the antenna 51 is deposited and a second portion 61 unitary with and projecting from the first portion 60 and onto which the conductive leads 52 and 53 are deposited. As the conductive leads 52 and 53 and the antenna 51 are mounted to the same face of the support structure 54, they may conveniently be deposited by the same metallisation. Once again, the support structure 54 is preferably made of a non-conductive dielectric material such as Kapton® or Espanex®.

The capacitive elements 58 and 59 are connected in series with the antenna coil segments 55, 56 and 57 by means of contact pads 62, 63, 64 and 65 deposited on the face of the support structure 54 shown in FIG. 8. Holes passing through the support structure 54 enable an electrical connection to be made—for example by the use of solder—between the contact pads 62, 63, 64 and 65 and the antenna 51. The placement of the conductive leads 52 and 53 on the support structure 51 and the manner in which they are connected to the RF module 6 are identical to that described in relation to the antenna structure 2 shown in FIGS. 1 to 5.

Figure 9:
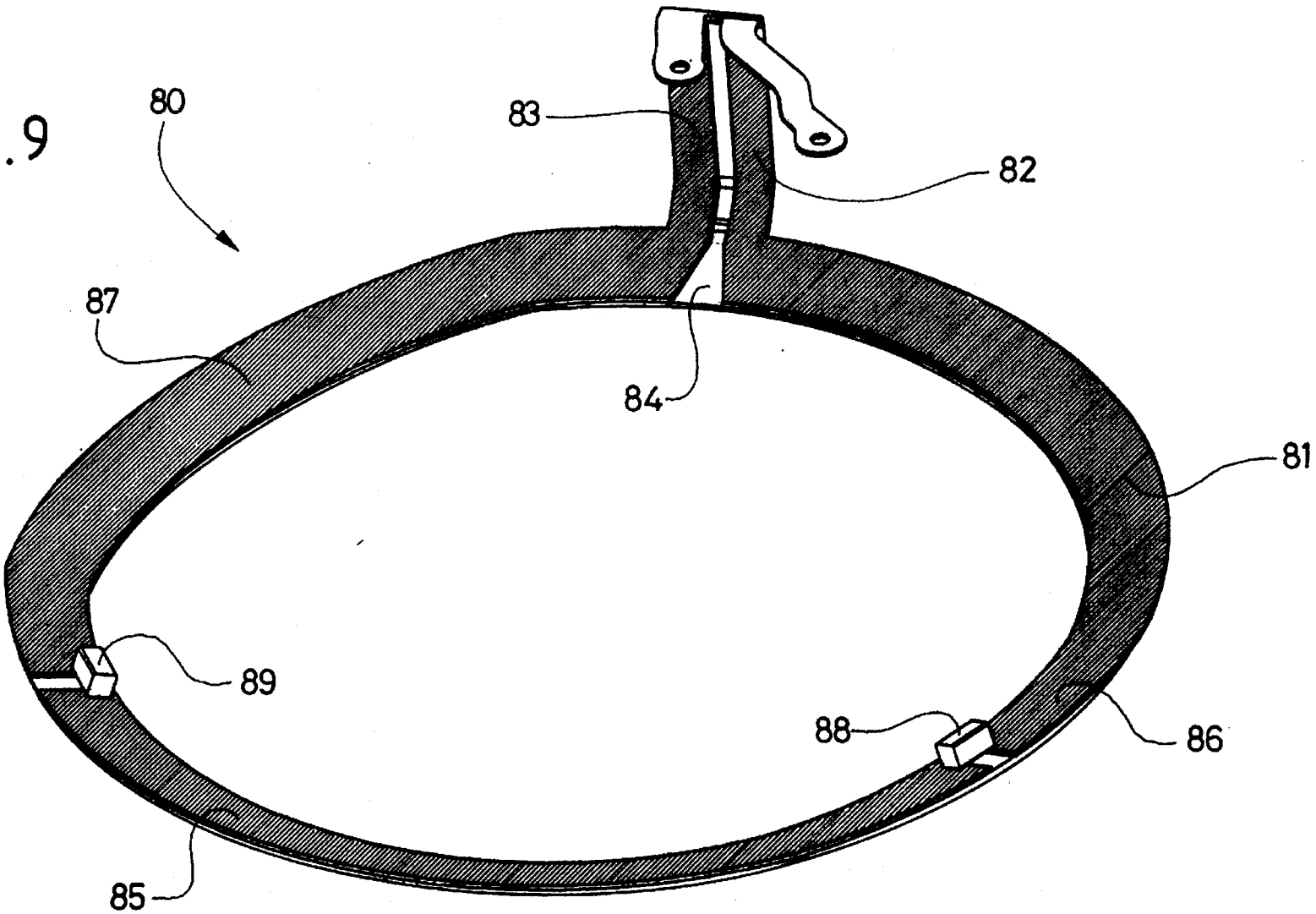
FIG. 9 is a perspective view of a third embodiment of the antenna structure according to the present invention.

Referring now to FIG. 9, there is a further antenna structure 80 according to the present invention. The antenna structure 80 comprises an antenna 81 and conductive leads 82 and 83 mounted to a support structure 84. The antenna 81 and the conductive leads 82 and 83 are constituted by a metallisation layer deposited onto the same surface of the support structure 84. The conductive leads 82 and 83 are unitary with the antenna 81 and are adapted to connect this latter to the RF module 6 of the microreceiver shown in FIG. 1. In this embodiment, however, the face of the support structure 84 onto which the conductive leads are deposited may advantageously be brought directly into contact with the input connections of the RF module 6 so that no metallisation or contact discs are required to be made on the opposing face of the support structure 84.

Figure 10:
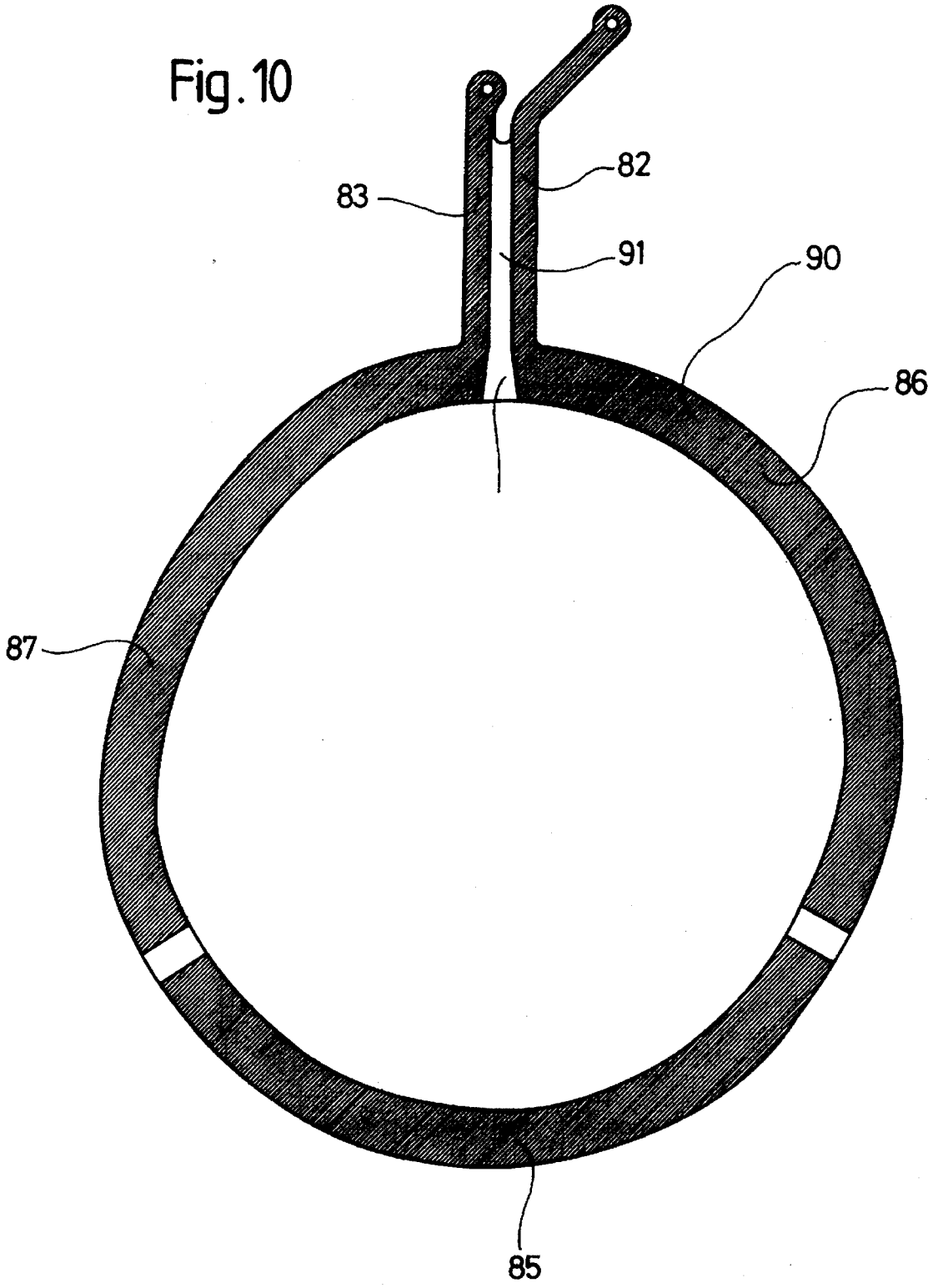
FIG. 10 is a plan view from above of the support structure of the antenna structure of FIG. 9, as seen from FIG. 9.

As in the previous embodiments, the antenna 81 is an inductive antenna which comprises one coil divided into three segments 85, 86 and 87. The three segments 85, 86 and 87 are made from copper or like-material. Capacitive elements 88 and 89 respectively interconnect the antenna coil segments 85 to 86 and 85 to 87. A further capacitive element (not shown) is provided on the RF module 6 of FIG. 1 and interconnects the coil segments 86 to 87. Advantageously, this embodiment enables the capacitive elements 88 and 89 to be mounted directly to the antenna coil segments 85, 86 and 89. FIG. 10 shows an overhead plan view, as seen from FIG. 9, of the antenna structure 80. For the sake of clarity, the capacitive elements 88 and 89 have been omitted from this view. The support structure 84 comprises a first portion 90 onto which the antenna 81 is deposited and a second portion 91 unitary with and projecting from the first portion 90 and onto which the antenna coil segments 85, 86 and 87 and the conductive leads 82 and 83 are deposited. As the conductive leads 82 and 83 and the antenna 81 are mounted to the same face of the support structure 84, they may conveniently be deposited by the same metallisation. As above, the support structure 84 is preferably made of a non-conductive, flexible membrane of dielectric material such as Kapton® or Espanex®.

The various embodiments of the antenna structure which have just been described are intended to be mounted in a timepiece adapted to be worn on the wrist or a like-member of the body such that the antenna captures the magnetic component of an electromagnetic field bearing radio diffused messages for receipt and transformation by the microreceiver into data perceptible to a user of the timepiece. According to Maxwell's equations, the electrical and magnetic components of an electromagnetic field are orthogonal to each other. Consequently, the electrical component of the field may be captured by a capacitive antenna while the magnetic component may be captured by an inductive antenna, this latter being realised by a coil having one or more windings.

The antenna 2 is intended to capture the magnetic field in the radial direction i.e. perpendicular to the skin of the wearer of a timepiece in which such an antenna is mounted. Accordingly, the antenna 2 is inductive and the longitudinal axis of the coil winding forming the antenna 2 is arranged perpendicular to the longitudinal direction of the bracelet. It will be appreciated by the skilled person that although the antenna 2 has only one winding, the actual number of windings constituting the antenna of the present invention will depend on the oscillating frequency of the alternating electromagnetic field to be captured. In general terms, fewer coil windings are required to capture a field as the oscillating frequency of that field increases.

Furthermore, other embodiments of the antenna structure may have more or fewer capacitive elements, or none at all, depending on the operating frequency and the dimensions of the antenna. As the operating frequency of the antenna increases, so too does the inductive impedance of the coil windings. Consequently, the tuning capacitance included in the RF module of the microreceiver will not be sufficiently small to be able to satisfy the resonance conditions of the antenna, due of its residual stray capacitance- To avoid this difficulty, capacitive elements such as those shown in FIGS. 1, 3 and 6 may be placed in series with the inductance of the coil windings in embodiments of the invention intended for use at higher operating frequencies. In yet other embodiments, inductive elements may be used in place of the capacitive elements described above, depending upon the desired characteristics of the antenna.

Figure 11:
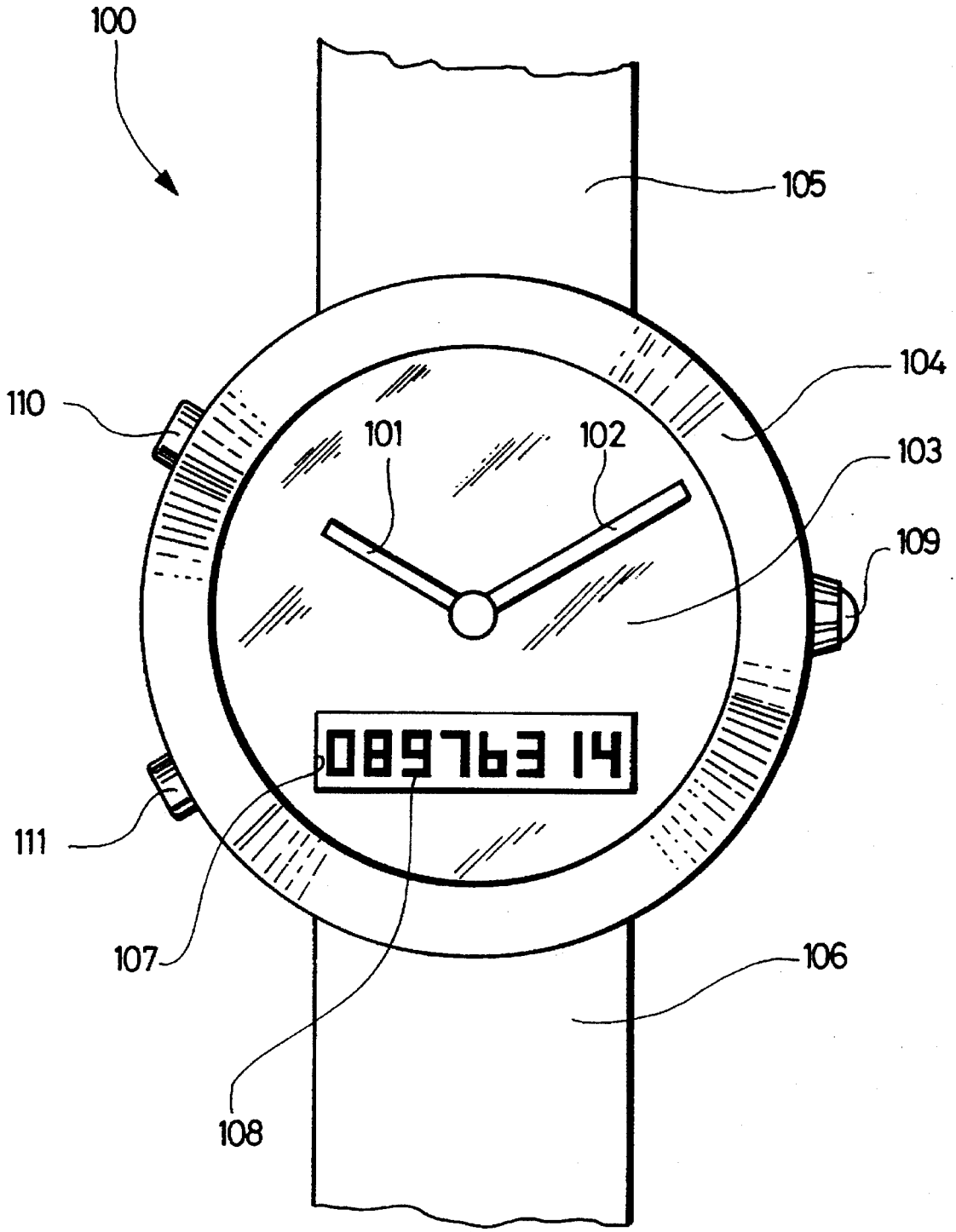
FIG. 11 is a plan view of a timepiece including an antenna structure according to the present invention.

FIG. 11 is a summary view of a timepiece 100 including an antenna structure according to the present invention. It includes analogue display means for the time of day with an hours hand 101 and a minutes hand 102, these hands rotating over a dial 103. On FIG. 11, there is seen the caseband 104 of the watch as well as the strands 105 and 106 of the bracelet attached thereto. In an opening 107 cut through the dial 103, there appears a display cell 108 for radio broadcast messages which assume a digital form and which may consist for instance of a telephone number to be called back. The watch is completed by a crown 109 for time setting the time display, by a first push-button 110 enabling the starting and stopping of the radio portion of the watch and by a second push-button 111 for preventing operation of an acoustic warning device mounted within the watch.

Figure 12:
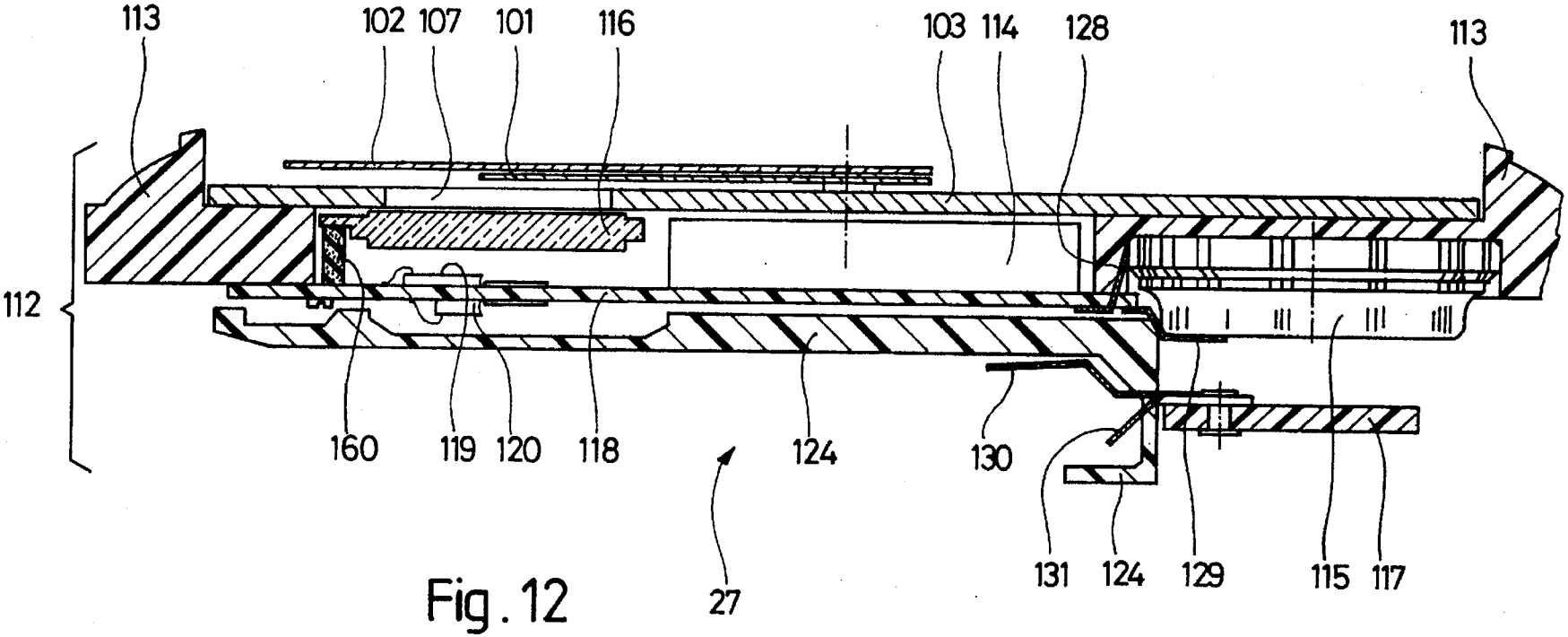
FIG. 12 is a cross-sectional view of the movement of the timepiece of FIG. 11.

FIGS. 12 to 17 are cross-sectional views taken in the watch 100 of FIG. 11 which explain its construction in detail. Referring now to FIG. 12, one sees that movement 112 comprises a baseplate 113 which serves to support various elements now to be described. To baseplate 113 is attached initially time display means which consist, in this embodiment, of a mechanism 114 driving the hours hand 101 and the minutes hand 102. Such mechanism may be itself driven in a known manner by a stepping motor (not shown). The time display means are controlled from a first energy source 115 consisting of a cell arranged in a housing in the baseplate 113. FIG. 12 shows that the baseplate 113 also bears a display cell 116 intended to cause radio broadcast messages to appear. The time display hands 101 and 102 rotate above dial 103, itself provided with an opening 107 allowing the user to read the indications displayed by the cell 116. Dial 103 is mounted on the baseplate 113.

Also attached to the baseplate 113, movement 112 further comprises electronic circuits in order to control the displays mentioned above. In the case of FIG. 12, such electronic circuits comprise two distinct modules, a first RF module 117 and a second digital module 118, although in other embodiments, the components constituting these latter may be mounted on a common base so as to form a single module The RF module receives the signals captured by the antenna mounted in the watch 100, as will be described hereinafter, amplifies such signal and then demodulates it. The digital module 118 receives the signal from the RF module 117 in order to control the display cell 116, for example through a zebra connector 160. One may find on such a digital module 118, in accordance with the functions with which it is desired to equip the watch, a decoder, a microprocessor and a RAM memory. In the example shown, the digital module 118 further bears electronic elements necessary in order to excite the stepping motor driving the mechanism 114, in particular a quartz, a frequency divider and a driver. Such various elements are symbolised by rectangles having the references 119 and 120.

Figure 13:
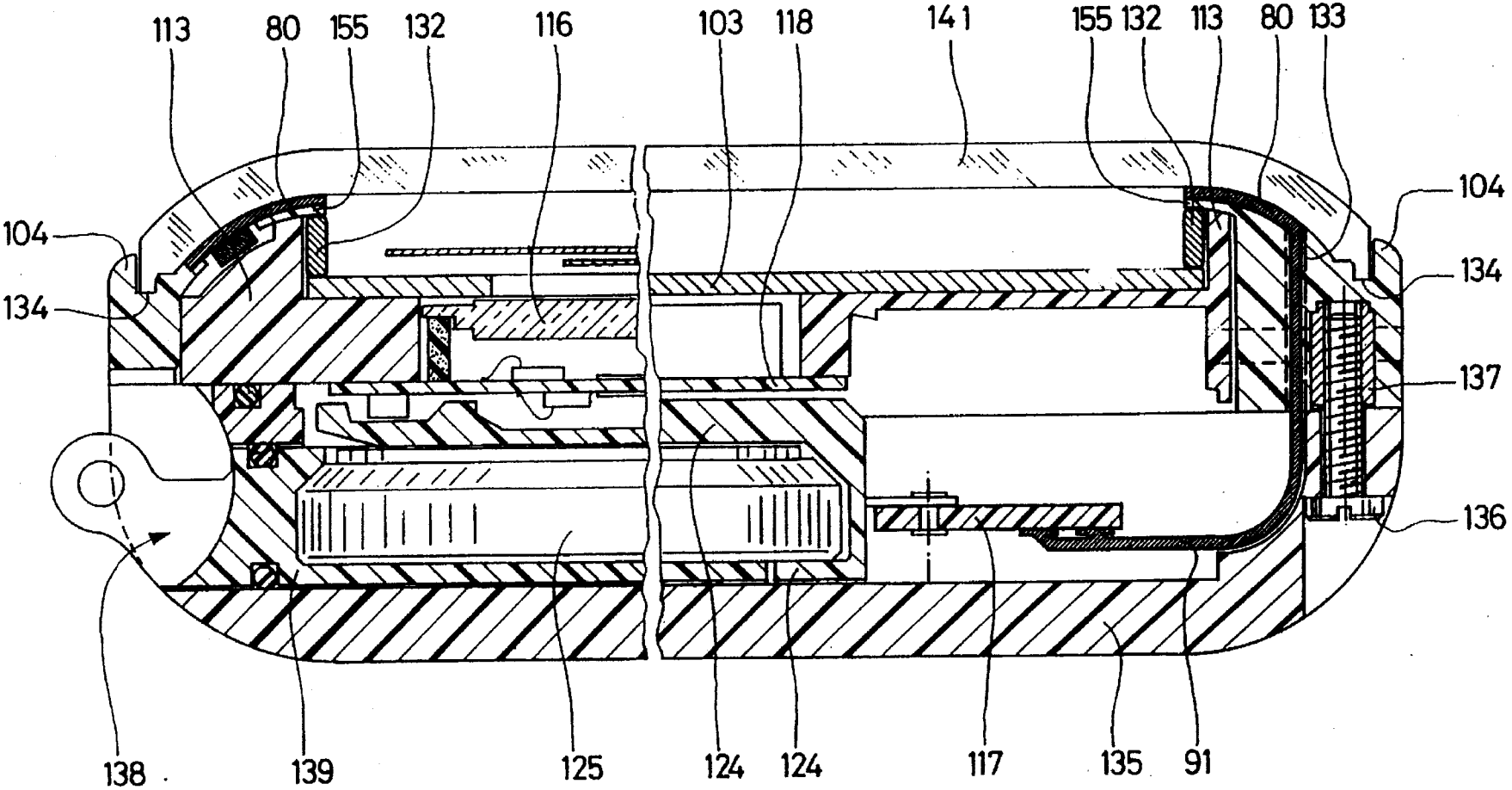
FIG. 13 is a cross-sectional view of the timepiece of FIG. 11 when completely assembled.

FIG. 12 also shows a casing 124 attached under the baseplate 113. Such casing acts to partially form a housing 27 for a second energy source or cell 125, as seen in FIG. 13, this latter figure showing a cross-sectional view of the timepiece 100 when completely assembled. The cell 115 intended to energise the time display mechanism is coupled electrically to the digital module 118 by connections 128 and 129. The cell 125, intended to energise the RF and digital modules is coupled to the RF module by connections 130 and 131.

The movement 112 as shown in FIG. 12 is then assembled to the caseband 104 by means of two fastening screws (not shown). During this operation, a flange 132 is introduced between the dial 103 and a bezel 155 in order to maintain the dial 103 in place. In this embodiment, the bezel 155, that is the member of the timepiece which supports the glass 141, is unitary with the caseband 104. In other embodiments, however, the bezel may be a separate piece from the caseband or even unitary with another piece of the watch.

Figure 14:
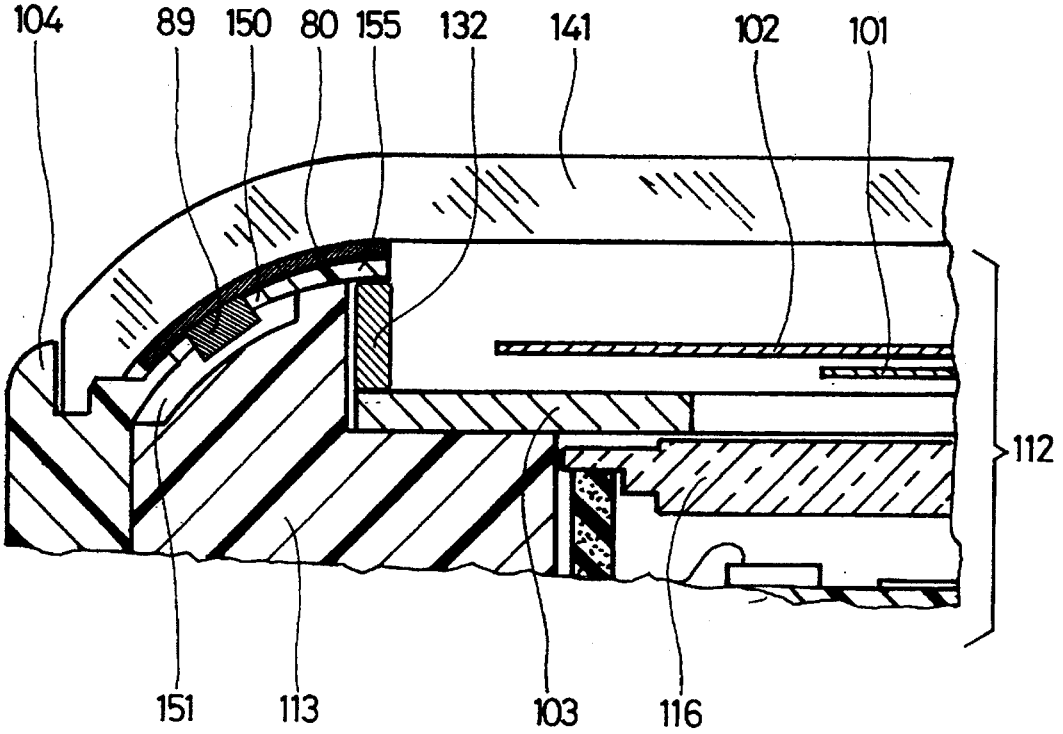
FIG. 14 is a first enlarged cross-sectional view showing one embodiment of the mounting of the antenna structure of the present invention in the timepiece of FIG. 11.
Figure 15:
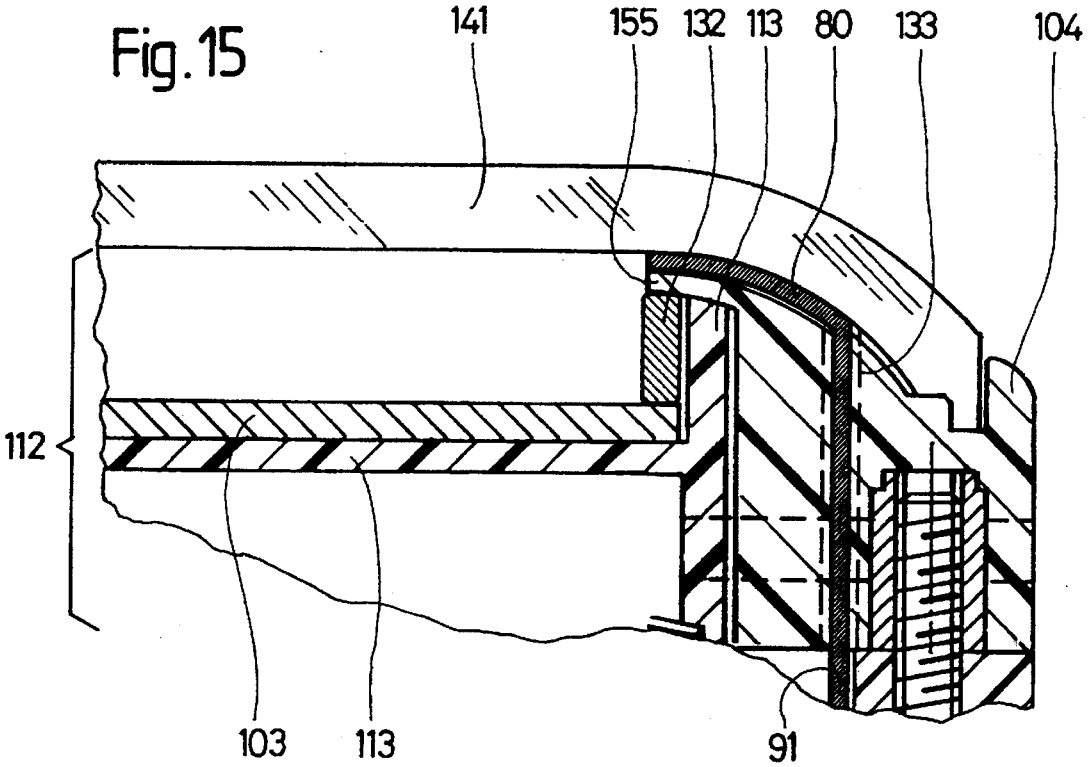
FIG. 15 is a second enlarged cross-sectional view of the antenna structure mounting embodiment illustrated in FIG. 14; and, FIG. 16 is a enlarged cross-sectional view showing a second embodiment of the mounting of the antenna structure of the present invention in the timepiece of FIG. 11.

Thereafter, the glass 141 to be fitted to the timepiece 100 is held with the exterior of the glass when the timepiece is assembled in a face down position, and an antenna structure such as that shown in FIGS. 9 and 10 located therein. FIGS. 14 and 15 show cross-sectional views of the left and right sides of the assembled timepiece 100, as seen from FIG. 13.

With the antenna structure 80 is position, the caseband 104 is brought into contact with the glass 141. As seen in FIG. 15, the antenna structure 80 is initially placed on the interior surface of the glass 141 so that the position of the second portion 91 of the support structure 84 corresponds to that of a slot 133 formed in the caseband 104. As the caseband 104 is brought into contact with the glass 141, the second portion 91 of the support structure 84 is folded with respect to the first portion 90 and fed through the slot 133. The connection of the conductive leads to the RF module 117 can then be simply achieved by bending the second portion of the support structure towards this module and soldering the two leads to appropriately located input connections. It will be understood that in other embodiments of the invention, means other than a slot in the caseband 104 may be provided in order to communicate the antenna structure with the RF module, depending upon the particular construction of the timepiece.

With the glass 141 and the caseband 104 in their assembled position, the glass 141 engages a peripheral groove 134 provided in the caseband 104. The glass 141 and the caseband 104 may then be secured to each other by the application of ultrasonic energy, this assuring a sealed connection between these two elements.

As soon as the movement 112 is secured to the caseband 104, the assembly of the timepiece is completed by fastening thereto the back cover 135. In this embodiment, the back cover 135 is fastened to the caseband 104 by means of six screws 136, a single one of which only is shown in FIG. 13. Each screw is screwed into a threaded insert 137 forced into the caseband 104.

FIG. 13 also shows that an opening 138 is provided laterally in the back cover 135, such opening providing access to the second energy source or cell 125, this latter being housed in a drawer 139 sliding between the casing 124 and the back cover 135, in order to permit replacement thereof.

As can be best seen in FIG. 14, the caseband 104 and the baseplate 113 may included openings 150 and/or indentations 151 in order to accommodate the capacitive elements, such as that referenced 89, mounted to the antenna structure to be located in the timepiece.

Figure 16:
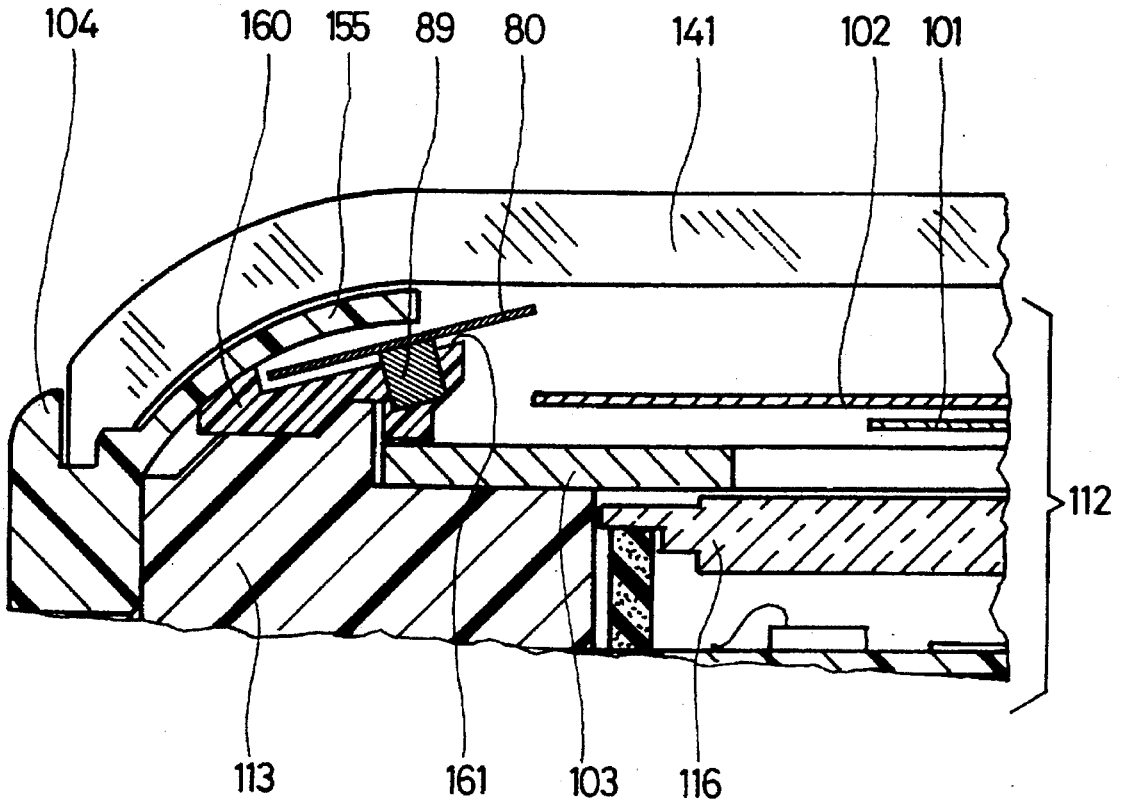

FIG. 16 shows a cross-sectional view of an alternative embodiment of mounting the antenna structure in a timepiece. In this embodiment, a flange 160 is mounted around the periphery of the dial 103 and baseplate 113 and acts to separate the bezel 155 from the dial 103. The flange 160 is provided with an inclined surface upon which the antenna structure 80 is mounted. Openings and/or indentations may also be provided in the flange 160 is order to accommodate the capacitive or other elements mounted to the antenna structure. The skilled person will readily conceive of other ways in which the antenna may conveniently be mounted to such a flange.

Whilst FIGS. 14 and 16 show two embodiments of the mounting of the antenna structure in the timepiece 100, the antenna structure may also be mounted in other ways For example, the first portion of the antenna structure may be fixed directly to the dial 103 or to the interior surface of the glass during assembly.

Finally, it is to be understood that various modifications and/or additions may be made to the antenna structure of the present invention and timepiece including such an antenna structure without departing from the ambit of the present invention as defined in the claims appended hereto.

In that regard, whilst each of the above described embodiments of the antenna structure relates to inductive antennas, the invention may also be applied in the case of capacitive antennas. For example, the upper plate of the capacitive antenna as shown in FIG. 8 of Swiss patent No. 672 870 could be incorporated into a suitable antenna structure, thus simplifying its mounting into a timepiece.

Moreover, it will be understood that whilst the timepiece illustrated in FIGS. 11 to 16 relates to a wristwatch including a paging device, the invention also applies to other timepieces and notably to radio-synchronised timepieces i.e. wristwatches and clocks which incorporate antennas and microreceivers for capturing radio diffused messages, these messages being used to set the correct time-of-day of the timepiece at regular intervals.

We claim:

1. An antenna structure for mounting inside the case of a timepiece (100) adapted to be worn on the wrist and including a microreceiver (117,118), said antenna structure comprising:

an antenna (81) comprising at least one coil (85,86,87) and being capable of capturing an electromagnetic field bearing radio diffused messages for receipt and transformation by said microreceiver (117,118) into data perceptible to a user of said timepiece;

conductive leads (82,83) for connecting said antenna (81) to said microreceiver (117,118); and, a non-conductive support structure (84) configured for mounting within the case of the timepiece and comprising a first portion (90) onto which said antenna (81) is mounted;

characterised in that said support structure (84) further comprises a second portion (91) unitary with and projecting from said first portion (90) and onto which said conductive leads (82,83) are mounted.

2. Antenna structure according to claim 1 characterised in that said second portion (91) is foldable with respect to said first portion (90).

3. Antenna structure according to claim 1, characterised in that said support structure (84) is made of a flexible material.

4. Antenna structure according to claim 3, characterised in that said support structure (84) is constituted by a flexible membrane of said flexible material.

5. Antenna structure according to claim 1, characterised in that said antenna (81) is deposited directly onto said support structure (84).

6. Antenna structure according to claim 1, characterised in that said conductive leads (82,83) are deposited directly onto support structure (84).

7. Antenna structure according to claim 1, characterised in that said conductive leads (82,83) are unitary with said antenna (81).

8. Antenna structure according to claim 1, characterised in that said antenna coil winding comprises a plurality of segments (85,86,87), and in that said antenna (81) further comprises capacitive or inductive elements (88,89) interconnecting adjacent ones of said segments.

9. Antenna structure according to claim 8, characterised in that said capacitive or inductive elements (88,89) are mounted on said support structure (84).

10. Antenna structure according to claim 8, characterised in that said capacitive or inductive elements (88,89) are mounted directly on said antenna (81).

11. Antenna structure according to claim 1, characterised in that said support structure first portion (90) has an annular shape.

12. Timepiece adapted to be worn on the wrist and including an antenna structure according to claim 1, characterised in that said timepiece further comprises:

case having at least a glass (132), a dial (103), a caseband (104), a bezel (155) and a back cover (135), said case housing, in addition to the elements necessary to display the time of day, a microreceiver (117,118) which receives and transforms messages capture by said antenna (81) into data perceptible to the wearer of the timepiece (100), said antenna structure (80) being mounted within the space bounded by said case, the axis of said coil being substantially perpendicular to the back cover (135) of said case.

13. Timepiece according to claim 12, characterised in that said antenna (81) and said support structure first portion (90) are mounted in the space bounded by the glass (132) and the dial (103).

14. Timepiece according to claim 13, characterised in that said antenna (81) and said support structure first portion (90) are mounted in said case between the glass (132) and the bezel (155).

15. Timepiece according to claim 14, characterised in that it further comprises a flange (132) mounted between said dial (103) and said bezel (155), said flange (132) acting to cause said bezel (155) to bear against the glass (132) through said antenna structure (80).

16. Timepiece according to claim 13, characterised in that it further comprises a flange (160) separating said glass (141) from said dial (103), and in that said antenna structure (80) is mounted in said case to said flange (160).

* * * * *